United States Patent [19]

Fujigaya et al.

[11] Patent Number: 4,624,221

[45] Date of Patent: Nov. 25, 1986

[54] COOLING SYSTEM FOR AUTOMOTIVE ENGINE OR THE LIKE

[75] Inventors: Kazuyuki Fujigaya, Yokosuka; Naoki Ogawa, Yokohama; Hitoshi Shimonosono, Yokosuka; Yutaka Minezaki, Koshigaya, all of Japan

[73] Assignee: Nissan Motor Co., Ltd., Yokohama, Japan

[21] Appl. No.: 780,934

[22] Filed: Sep. 27, 1985

[30] Foreign Application Priority Data

Sep. 29, 1984 [JP] Japan ..... 59-204586

[51] Int. Cl.[4] ..... F01P 3/22

[52] U.S. Cl. ..... 123/41.08; 123/41.27; 123/41.44

[58] Field of Search ..... 123/41.08, 41.2–41.27, 123/41.44; 165/104.27, 104.32

[56] References Cited

U.S. PATENT DOCUMENTS

| | | | |
|---|---|---|---|
| 4,367,699 | 1/1983 | Evans | 123/41.54 |
| 4,549,505 | 10/1985 | Hirano | 123/41.27 |
| 4,570,579 | 2/1986 | Hirano | 123/41.27 |

FOREIGN PATENT DOCUMENTS

| | | | |
|---|---|---|---|
| 137410 | 4/1985 | European Pat. Off. | 123/41.21 |
| 153694 | 9/1985 | European Pat. Off. | 123/41.27 |
| 194028 | 11/1984 | Japan | 123/41.21 |

*Primary Examiner*—William A. Cuchlinski, Jr.

*Attorney, Agent, or Firm*—Schwartz, Jeffery, Schwaab, Mack, Blumenthal & Evans

[57] ABSTRACT

In order to minimize the number of valves and conduits and the amount of coolant must be carried in an auxiliary reservoir of an evaporative type automotive cooling system, the valve and conduit arrangement which communicates the normally closed circuit cooling system with the reservoir consists of only two conduits and two valves. When the engine is stopped the cooling circuit is allowed to fill completely with the coolant from the reservoir. When the engine is started a low temperature non-condensible matter purge operation is avoided and if the temperature rises above a target value, either coolant is pumped out of the system (if excess coolant is available therein) or high temperature vapor is vented from the bottom of the radiator in bursts to purge out the non-condensible matter.

7 Claims, 13 Drawing Figures

COOLING SYSTEM FOR AUTOMOTIVE ENGINE OR THE LIKE

BACKGROUND OF THE INVENTION

1. Field of the Invention

The present invention relates generally to a cooling system for an internal combustion engine wherein a liquid coolant is permitted to boil and the vapor used as a vehicle for removing heat from the engine, and more specifically to such a system which maintains the cooling circuit essentially free of contaminating air while minimizing both the complexity of the system and the amount of additional coolant which must be stored in an auxiliary reservoir which forms a vital part of the system.

2. Description of the Prior Art

In currently used 'water cooled' internal combustion engine such as shown in FIG. 1 of the drawings, the engine coolant (liquid) is forcefully circulated by a water pump, through a cooling circuit including the engine coolant jacket and an air cooled radiator. This type of system encounters the drawback that a large volume of water is required to be circulated between the radiator and the coolant jacket in order to remove the necessary amount of heat. Further, due to the large mass of water inherently required, the warm-up characteristics of the engine are undesirably sluggish. For example, if the temperature difference between the inlet and discharge ports of the coolant jacket is 4 degrees, the amount of heat which 1 Kgm of water may effectively remove from the engine under such conditions is 4 Kcal. Accordingly, in the case of an engine having 1800 cc displacement (by way of example) is operated full throttle, the cooling system is required to removed approximately 4000 Kcal/h. In order to achieve this, a flow rate of 167 liter/min (viz., $4000-60\times\frac{1}{4}$) must be produced by the water pump. This of course undesirably consumes a number of useful horsepower.

FIG. 2 shows an arrangement disclosed in Japanese Patent Application Second Provisional Publication Sho. No. 57-57608. This arrangement has attempted to vaporize a liquid coolant and use the gaseous form thereof as a vehicle for removing heat from the engine. In this system the radiator 1 and the coolant jacket 2 are in constant and free communication via conduits 3, 4 whereby the coolant which condenses in the radiator 1 is returned to the coolant jacket 2 little by little under the influence of gravity.

This arrangement while eliminating the need for the the power consuming circulation pump which plagues the above described arrangement, has suffered from the drawbacks that the radiator, depending on its position with respect to the engine proper, tends to be at least partially filled with liquid coolant. This greatly reduces the surface area via which the gaseous coolant (for example steam) can effectively release its latent heat of vaporization and accordingly condense, and thus has lacked any notable improvement in cooling efficiency.

Further, with this system in order to maintain the pressure within the coolant jacket and radiator at atmospheric level, a gas permeable water shedding filter 5 is arranged as shown, to permit the entry of air into and out of the system. However, this filter permits gaseous coolant to gradually escape from the system, inducing the need for frequent topping up of the coolant level.

A further problem with this arrangement has come in that some of the air, which is sucked into the cooling system as the engine cools, tends to dissolve in the water, whereby upon start up of the engine, the dissolved air tends to form small bubbles in the radiator which adhere to the walls thereof forming an insulating layer. The undissolved air also tends to collect in the upper section of the radiator and inhibit the convention-like circulation of the vapor from the cylinder block to the radiator. This of course further deteriorates the performance of the device.

European Patent Application Provisional Publication No. 0 059 423 published on Sept. 8, 1982 discloses another arrangement wherein, liquid coolant in the coolant jacket of the engine, is not forcefully circulated therein and permitted to absorb heat to the point of boiling. The gaseous coolant thus generated is adiabatically compressed in a compressor so as to raise the temperature and pressure thereof and thereafter introduced into a heat exchanger (radiator). After condensing, the coolant is temporarily stored in a reservoir and recycled back into the coolant jacket via a flow control valve.

This arrangement has suffered from the drawback that air tends to leak into the system upon cooling thereof. This air tends to be forced by the compressor along with the gaseous coolant into the radiator. Due to the difference in specific gravity, the air tends to rise in the hot environment while the coolant which has condensed moves downwardly. Accordingly, air, due to this inherent tendency to rise, forms pockets of air which cause a kind of 'embolism' in the radiator and badly impair the heat exchange ability thereof.

U.S. Pat. No. 4,367,699 issued on Jan. 11, 1983 in the name of Evans (see FIG. 3 of the drawings) discloses an engine system wherein the coolant is boiled and the vapor used to remove heat from the engine. This arrangement features a separation tank 6 wherein gaseous and liquid coolant are initially separated. The liquid coolant is fed back to the cylinder block 7 under the influence of gravity while the 'dry' gaseous coolant (steam for example) is condensed in a fan cooled radiator 8. The temperature of the radiator is controlled by selective energizations of the fan 9 to maintain a rate of condensation therein sufficient to maintain a liquid seal at the bottom of the device. Condensate discharged from the radiator via the above mentioned liquid seal is collected in a small reservoir-like arrangement 10 and pumped back up to the separation tank via a small constantly energized pump 11.

This arrangement, while providing an arrangement via which air can be initially purged to some degree from the system tends to, due to the nature of the arrangement which permits said initial non-condensible matter to be forced out of the system, suffer from rapid loss of coolant when operated at relatively high altitudes. Further, once the engine cools air is relatively freely admitted back into the system.

The provision of the separation tank 6 also renders engine layout difficult in that such a tank must be placed at relatively high position with respect to the engine, and contain a relatively large amount of coolant so as to buffer the fluctuations in coolant consumption in the coolant jacket. That is to say, as the pump 11 which lifts the coolant from the small reservoir arrangement located below the radiator, is constantly energized (apparently to obivate the need for level sensors and the like arrangement which could control the amount of coolant returned to the coolant jacket) the amount of coolant stored in the seperation tank must be sufficient as to allow for sudden variations in the amount of coolant consumed in the coolant jacket due to sudden changes in the amount of fuel combusted in the combustion chambers of the engine.

Japanese patent application First Provisional Publication sho. No. 56-32026 (see FIG. 4 of the drawings) discloses an arrangement wherein the structure defining the cylinder head and cylinder liners are covered in a porous layer of ceramic material 12 and coolant sprayed into the cylinder block from shower-like arrangements 13 located above the cylinder heads 14. The interior of the coolant jacket defined within the engine proper is essentially filled with only gaseous coolant during engine operation during which liquid coolant is sprayed onto the ceramic layers 12. However, this arrangement has proven totally unsatisfactory in that upon boiling of the liquid coolant absorbed into the eramic layers, the vapor thus produced and which escapes into the coolant jacket inhibits the penetration of fresh liquid coolant and induces the situation wherein rapid overheat and thermal damage of the ceramic layers 12 and/or engine soon results. Further, this arrangement is plagued with air contamination and blockages in the radiator similar to the compressor equipped arrangement discussed above.

FIG. 7 shows an arrangement which is disclosed in copending U.S. patent application Ser. No. 663,911 filed on Oct. 23, 1984 in the name of Hirano now U.S. Pat. No. 4,549,505. The disclosure of this application is hereby incorporated by reference thereto. For convenience the same numerals as used in the just mentioned application are also used in FIG. 7 so as to facilitate ready understanding of same.

However, this arrangement while overcoming many of the problems encountered by the prior art by (a) filling the cooling circuit defined by coolant jacket, radiator and interconnecting conduiting with coolant from an auxiliary reservoir when the engine is stopped and (b) performing non-condensible matter purges when the engine is subject to cold starts, has itself encountered the drawback that in order to execute the purge operation which is executed during cold engine starts, sufficient coolant must be stored in the reservoir 146 and requires valves and conduits which tend to clutter the already crowded environment of the modern automotive vehicle engine compartment. Hence, the system tends to be heavier and more complex than preferred.

SUMMARY OF THE INVENTION

It is an object of the present invention to provide an evaporative type cooling system for an automotive internal combustion engine or the like which is relatively simple in construction and which reduces the amount of reserve coolant which must be carried with the engine for the purposes of preventing the entry of non-condensible matter such as atmospheric air into the system when the engine is stopped and/or operating under conditions when sub-atmosperic conditions tend to prevail within the cooling circuit of the system.

In brief, the above object is achieved by an arrangement wherein in order to minimize the number of valves and conduits and the amount of coolant must be carried in an auxiliary reservoir of an evaporative type automotive cooling system, the valve and conduit arrangement which communicates the normally closed circuit cooling system with the resevoir consists of only two conduits and two valves. When the engine is stopped the cooling circuit is allowed to fill completely with the coolant from the reservoir. When the engine is started, a low temperature non-condensible matter purge operation is avoided and if the temperature rises above a target value, either coolant is pumped out of the system (if excess coolant is available therein) or high temperature vapor is vented from the bottom of the radiator in bursts to purge out the non-condensible matter.

More specifically, a first aspect of the present invention takes the form of an internal combustion engine having a structure subject to high heat flux and a cooling system which is characterized by: (a) a cooling circuit for removing heat from the structure, the cooling circuit comprising: a coolant jacket disposed about the structure and into which coolant is introduced in liquid form and permitted to boil; radiator in which coolant vapor is condensed to its liquid form; a vapor transfer conduit leading from a vapor collection space defined in the coolant jacket to the radiator; means for returning liquid coolant from the radiator to the coolant jacket in a manner which maintains the structure immersed in a predetermined depth of liquid coolant, the liquid coolant returning means including: a coolant return conduit leading from the bottom of the radiator to the coolant jacket, and a pump disposed in the coolant return conduit, the pump being selectively energizable to return coolant from the radiator to the coolant jacket through the coolant return conduit; (b) a reservoir in which liquid coolant is stored; and (c) valve and conduit means for selectively providing fluid communication between the reservoir and the cooling circuit, the valve and conduit means consisting of: a first valve disposed in the coolant return conduit at a location between the pump and the coolant jacket, the first valve having a first position wherein communication between the pump and the coolant jacket is established and a second position wherein communication between the reservoir and the pump is established via a level control conduit which leads from the reservoir to the first valve, the pump being reversible so as to enable coolant to be pumped into or out of the coolant circuit when the first valve is in the second position; a fill/discharge conduit which leads from the reservoir to the bottom of the radiator; and a second valve disposed in the fill/discharge conduit; the second valve having a first position wherein communication between the reservoir and the radiator is cut-off and a second position wherein communication is permitted.

A further aspect of the present invention comes in a method of cooling an internal combustion engine having a structure subject to high heat flux comprising the steps of: introducing liquid coolant into a coolant jacket disposed about the structure; permitting the coolant to boil and produce coolant vapor; condensing the coolant vapor produced in the coolant jacket to its liquid form in a radiator; using a pump to return the liquid coolant from the radiator to the coolant jacket in a manner which maintains the structure immersed in a predetermined depth of coolant; storing liquid coolant in a reservoir; controlling the communication between the reservoir and a cooling circuit including the coolant jacket and the radiator using a first conduit which leads from the reservoir to the cooling circuit at a location between the pump and the coolant jacket; a first valve which selectively provides communication between the pump and the reservoir via the first conduit and communication between the pump and the coolant jacket; a second conduit which leads from the bottom of the radiator to the reservoir; and a second valve which selectively provides and cuts-off fluid commuication between the radiator and the reservoir via the second conduit; permitting coolant from the reservoir to be inducted into the coolant jacket and radiator when the engine is stopped and below a predetermined temperature; displacing coolant from the coolant jacket and radiator to the reservoir via the second conduit when the engine is started and warming up; and controlling the temperature and pressure in the coolant jacket and radiator by: (i) increasing the exchange of heat between the radiator and a cooling medium surrounding same, (ii) pumping coolant into and out of the radiator and coolant jacket using the pump; and (iii) venting coolant vapor from the radiator via the second conduit when the temperature of the coolant in the coolant jacket rises above a maximum permissible level.

BRIEF DESCRIPTION OF THE DRAWINGS

The features and advantages of the arrangement of the present invention will become more clearly appreciated from the following description taken in conjunction with the following drawings in which.

DETAILED DESCRIPTION OF THE PREFERRED EMBODIMENT

Before proceeding with the description of the embodiments of the present invention, it is deemed appropriate to discuss some of the features of the type of cooling system to which the present invention is directed.

Figure 1:
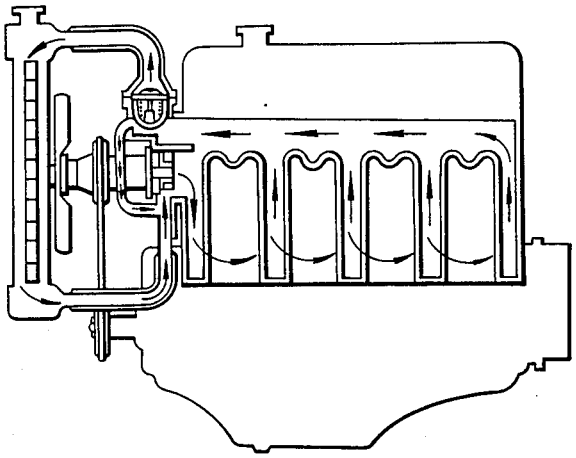
FIG.1 (PRIOR ART)
FIGS. 1 to 4 show the prior art arrangements discussed in the opening paragraphs of the instant disclosure.
Figure 2:
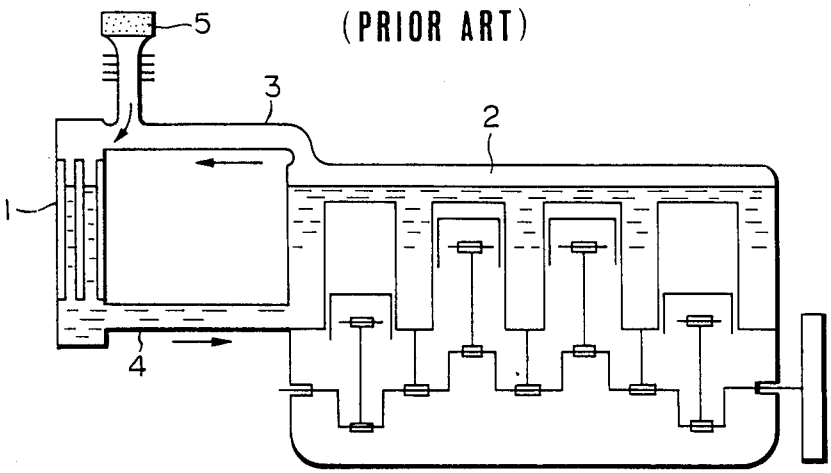
FIG.2 (PRIOR ART)
Figure 3:
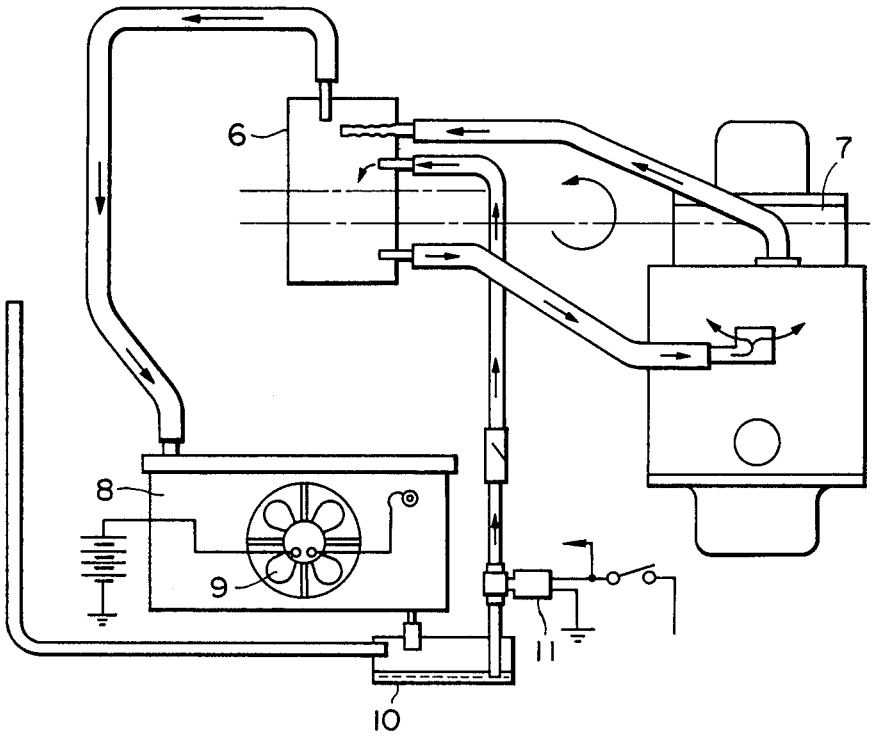
FIG.3 (PRIOR ART)
Figure 4:
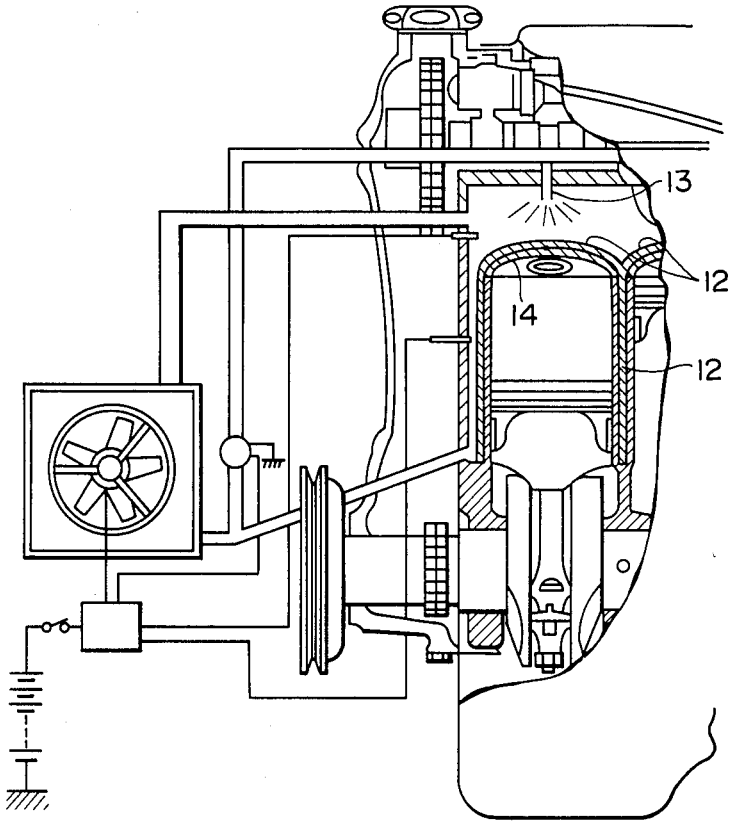
FIG.4 (PRIOR ART)
Figure 5:
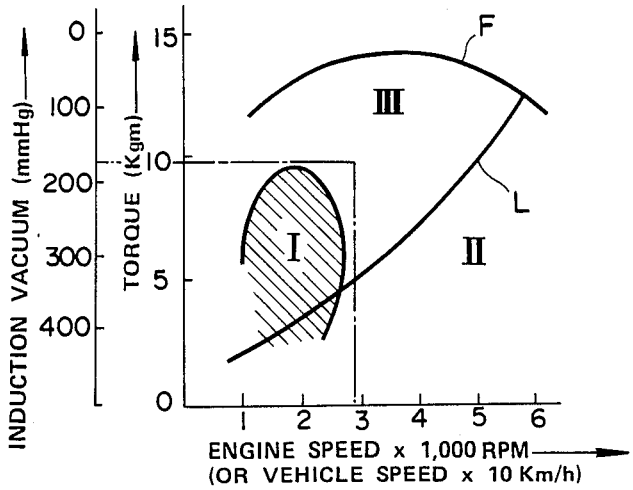
FIG. 5 is a graph showing in terms of induction vacuum (load) and engine speed the various load zones encountered by an automotive internal combustion engine.
Figure 6:
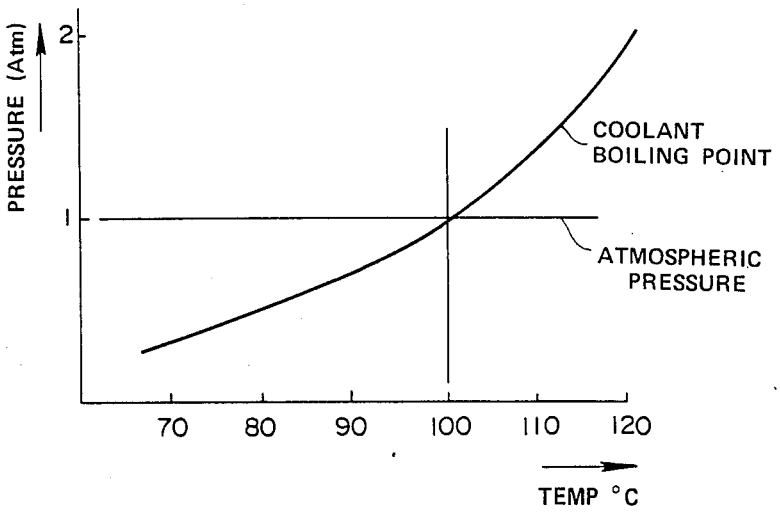
FIG. 6 is a graph showing in terms of pressure and temperature, the change which occurs in the coolant boiling point with change in pressure.

FIG. 5 graphically shows in terms of engine torque and engine speed the various load 'zones' which are encountered by an automotive vehicle engine. In this graph, the curve F denotes full throttle torque characteristics, trace L denote the resistance encountered when a vehicle is running on a level surface, and zones I, II and III denote respectively 'urban cruising', 'high speed cruising' and 'high load operation' (such as hill-climbing, towing etc.).

A suitable coolant temperature for zone I is approximately 110° C. while 90°–80° C. for zones II and III. The high temperature during 'urban cruising' promotes improved thermal efficiency while simultaneously removing sufficient heat from the engine and associated structure to prevent engine knocking and/or engine damage in the other zones. For operational modes which fall between the aforementioned first, second and third zones, it is possible to maintain the engine coolant temperature at approximately 100° C.

Figure 7:
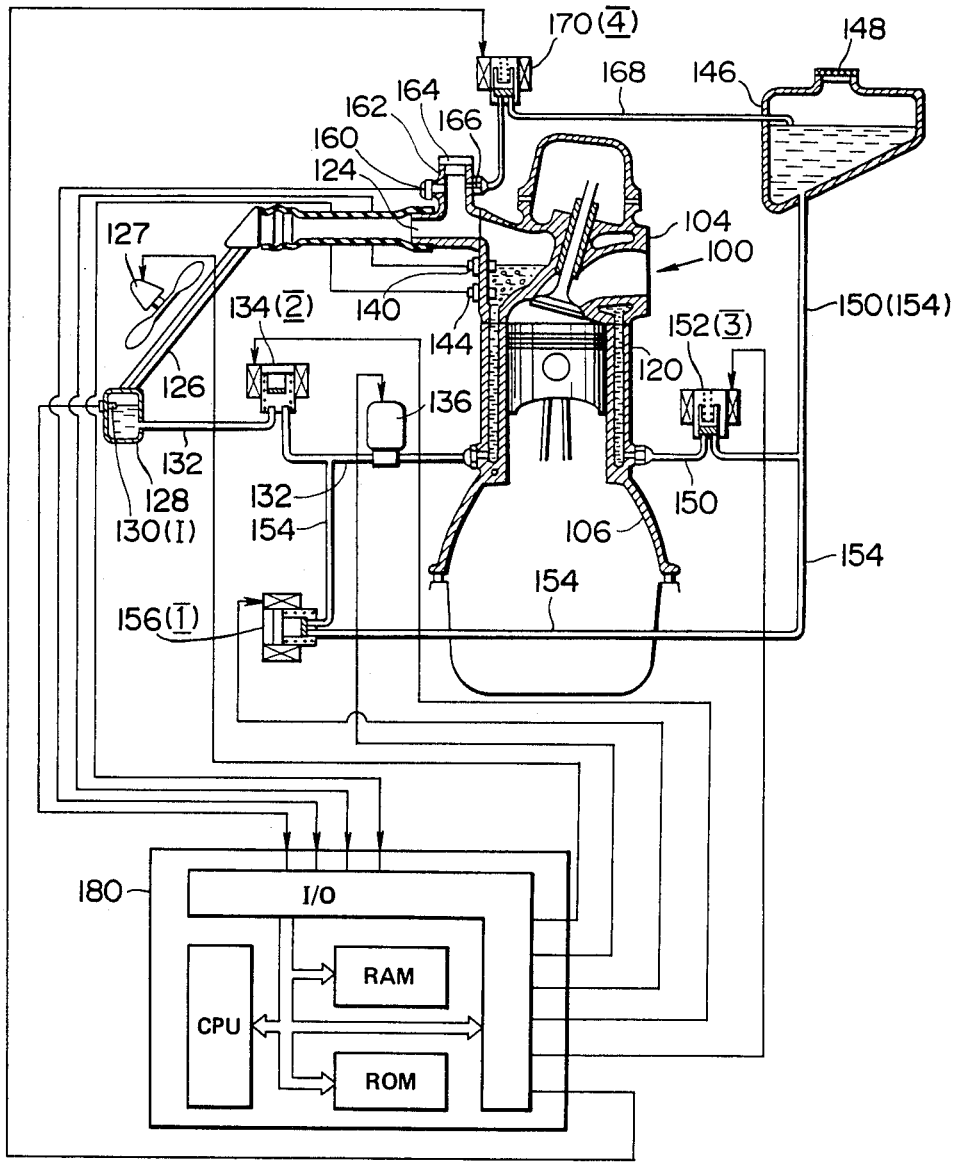
FIG. 7 shows in schematic elevation the arrangement disclosed in the opening paragraphs of the instant disclosure in conjunction with copending U.S. patent application Ser. No. 663,911.

With the present invention, in order to control the temperature of the engine, advantage is taken of the fact that with a cooling system wherein the coolant is boiled and the vapor used a heat transfer medium, the amount of coolant actually circulated between the coolant jacket and the radiator is very small, the amount of heat removed from the engine per unit volume of coolant is very high, and upon boiling, the pressure prevailing within the coolant jacket and consequently the boiling point of the coolant rises if the system employed is closed. Thus, by circulating only a limited amount of cooling air over the radiator, it is possible reduce the rate of condensation therein and cause the pressure within the cooling system to rise above atmospheric and thus induce the situation, as shown in FIG. 7, wherein the engine coolant boils at temperatures above 100° C. for example as high as approximately 119° C. (corresponding to a pressure of approximately 1.9 Atmospheres).

On the other hand, during high speed cruising, it is further possible by increasing the flow cooling air passing over the radiator, to increase the rate of condensation within the radiator to a level which reduces the pressure prevailing in the cooling system below atmospheric and thus induce the situation wherein the coolant boils at temperatures in the order of 80° to 90° C. However, under such conditions the tendency for air to find its way into the interior of the cooling circuit becomes excessively high and it is desirable under these circumstances to limit the degree to which a negative pressure is permitted to develop. This can be achieved by permitting coolant to be introduced into the cooling circuit from the reservoir and thus raise the pressure in the system to a suitable level.

Figure 8:
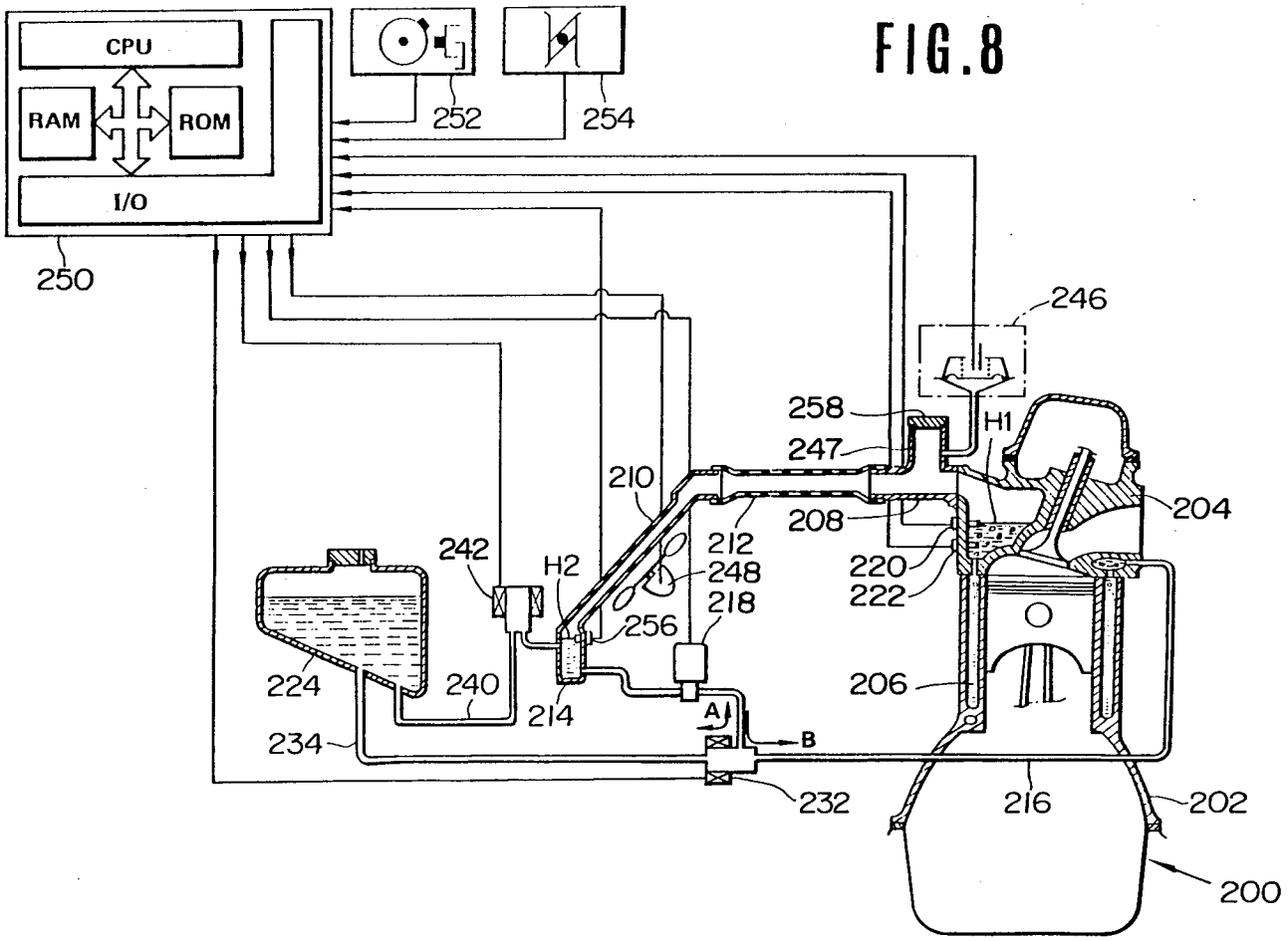
FIG. 8 shows an embodiment of the present invention.

FIG. 8 shows an embodiment of the present invention. In this arrangement an engine 200 includes a cylinder block 202 on which a cylinder head 204 is detachably mounted. The cylinder block and cylinder head are formed with cavities which define a coolant jacket 206 about the heated structure of the engine.

A vapor manifold 208 is detachably mounted on the cylinder head 204 and arranged to communicate with a condensor or radiator (as it will be referred to hereinafter) 210 via a vapor transfer conduit 212.

In this embodiment the radiator 210 comprises a plurality of relatively small diameter conduits which terminate in a small collection vessel or lower tank 214. A coolant return conduit 216 leads from the lower tank 214 to the coolant jacket 206. In this embodiment the return conduit 216 communicates with the cylinder head 204 at a location proximate the most highly heated structure of the engine 200. This arrangement introduces the relatively cool coolant into a section of the coolant jacket 206 where the most vigorous boiling tends to occur and therefore tends to attenuate the bumping and frothing which normally accompanies same. However, it is also within the scope of the present invention to connect the return conduit 216 to a port formed in the section of the coolant jacket 206 defined within the cylinder block 202 if so desired.

A small capacity coolant reversible return pump 218 is disposed in conduit 216 as shown. This pump is aranged to be selectively energizable to pump coolant from said lower tank 214 toward the coolant jacket 206 (viz., a first flow direction) and in the reverse direction (second flow direction). The reason for this arrangement will become clear hereinlater.

In order to control the operation of pump 218 (in the first flow direction) a first level sensor 220 is disposed in the coolant jacket. As shown, this level sensor 220 is arranged at a level H1 which is selected to be a predetermined height above the structure which defines the cylinder heads, exhaust ports and valves of the engine (viz., structure subject to a high heat flux) so as to maintain same immersed in sufficient coolant and thus obviate the formation of localized dryouts (induced by excessively violent bumping and frothing of the coolant) and thus avoid engine damage due to localized overheating and the like. This sensor may be arranged to exhibit hysteresis characteristics so as to prevent rapid ON/OFF cycling of pump 218.

Disposed below the level sensor 220 so as to be securely immersed in liquid coolant and in relatively close proximity to the most highly heated structure of the engine is a temperature sensor 222.

A reservoir 224, the interior of which is maintained constantly at atmospheric pressure, is arranged to fluidly communicate with what shall be referred to as a 'cooling circuit' (viz., a circuit comprised of the coolant jacket 206, the vapor manifold 208, the vapor transfer conduit 212 and coolant return conduit 216) via a 'valve and conduit' arrangement. In this embodiment the valve and conduit arrangement comprises a three-way valve 232 disposed in the coolant return conduit 216 and which is arranged to have a first position wherein communication between the pump 218 and the reservoir 224 is established via an level control conduit 234 which leads from the reservoir to three-way valve 232 (viz., establish flow path A) and a second position wherein communication between the pump 216 and the coolant jacket 206 established (flow path B); a fill/displacement conduit 240 which leads from the reservoir 224 to the lower tank 214; and an ON/OFF valve 242 which is disposed in conduit 240 and which permits communication between the lower tank 214 and the reservoir 224 when de-energized and which cuts-off said communication upon energization.

In order to sense the pressure prevailing in the cooling circuit a pressure differential responsive switch arrangement 246 is arranged to communication with a riser section 247 formed in the vapor manifold 208. This device is set so as to issue a signal upon the pressure in the cooling circuit dropping by a predetermined small amount below atmospheric.

A small electric fan 248 or like device is disposed beside the radiator 210 and arranged to force a draft of air over the surface thereof and thus induce an increase in the heat exchange between the radiator and the surrounding atmospheric air.

A control cirucit 250 which in this embodiment includes a microprocessor comprising a CPU, a RAM a ROM and an in/out interface I/O, is arranged to receive inputs from temperature sensor 222 and level sensor 220. This circuit also receives data inputs from an engine speed sensor 252, a engine load sensor 254 and a second level sensor 256 disposed in lower tank 214 at a level essentially equal to that at which the fill/discharge conduit 240 communicates with same.

The ROM of the microprocessor contains various control programs which are used to control the operation of the fan, pump and valves, and of the valve and conduit arrangement. These programs will be discussed in some detail hereinlater.

Prior being put into use it is necessary to completely fill the cooling circuit with coolant and displace any non-condensible matter. To do this it is possible to remove the cap 258 which closes the riser 247 and manually fill the system with liquid coolant (for example water or a mixture of water and anti-freeze). Alternatively, or in combination with the above, it is possible to introduce excess coolant into reservoir 224, condition valve 232 to produce flow path A and energize pump 218 to pump in the second flow direction until such time as coolant may be visibly seen spilling out of the open riser 228. By securing the cap in place at this time it is possible to hermetically seal the system in a completely filled condition.

SYSTEM CONTROL ROUTINE

Figure 9:
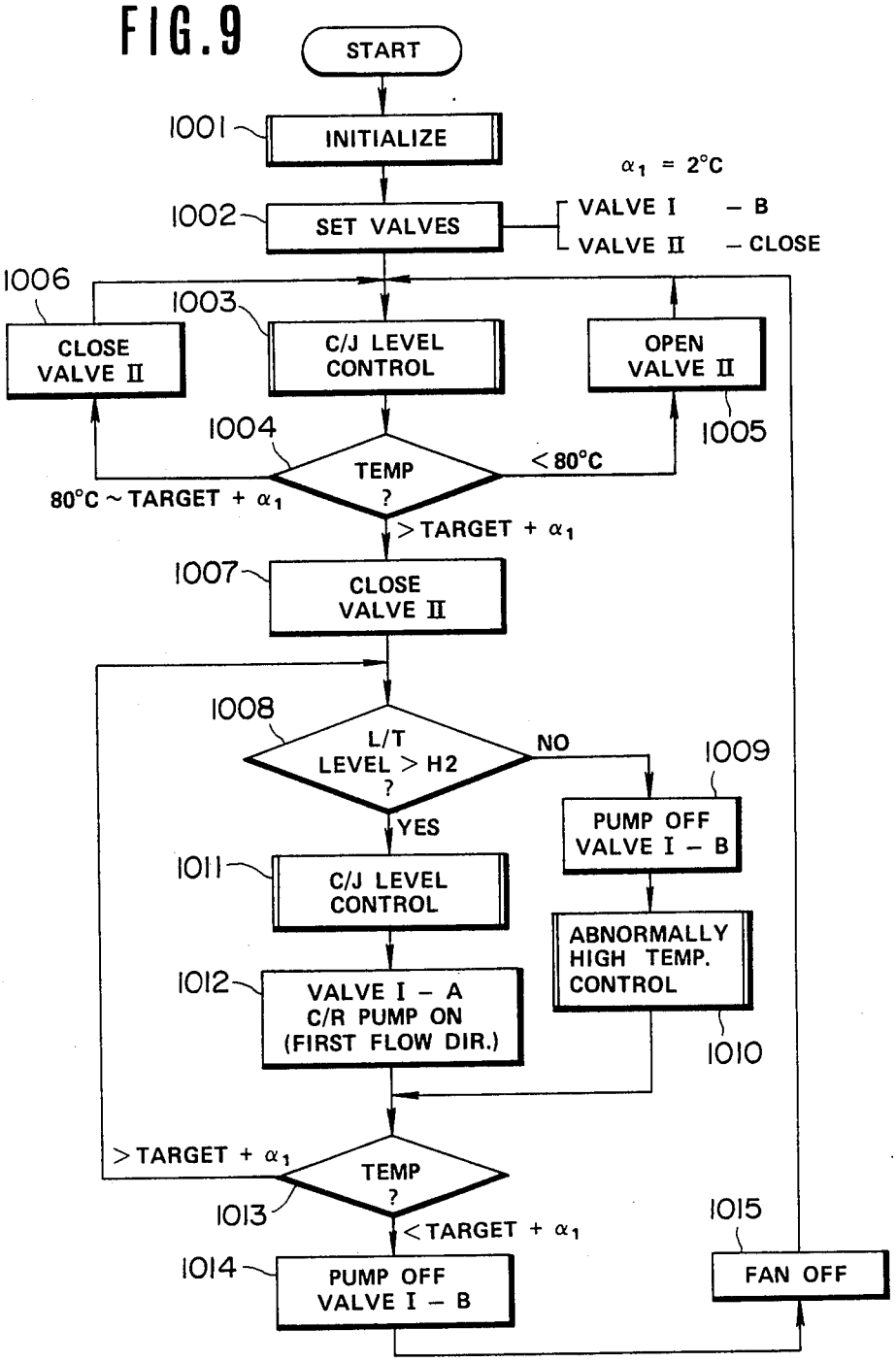
FIGS. 9 to 13 show flow charts which depict the operations which characterize the control of the arrangement shown in FIG. 8.

FIG. 9 shows in flow chart form a control routine which manages the overall operation of the cooling system shown in FIG. 8. As shown, subsequent to start of the engine and initialization of the system, at step 1001 the valves of the system are conditioned so that valve 232 establishes flow path B while valve 242 is closed. It should be noted that throughout the discussion of the flow charts of FIGS. 9 to 13 a convention wherein valve 232 will be referred to as valve I and valve 242 to as valve II will be adopted for simplicity.

At step 1003 a coolant jacket (C/J) level control routine is implemented. Following this at step 1004 the temperature of the coolant is determined by sampling the output of temperature sensor 222. In the event that the temperature of the coolant is below 80° C. then the program flows to step 1005 wherein valve II is opened to render the system open circuit and thus permit coolant to be inducted to displaced from the lower tank 214 in accordance with the pressure differential which exists between the interior of the radiator and the ambient atmosphere. Following step 1005 the program recycles to step 1004. However, if the temperature of the coolant is found to be between 80° C. and a value equal to Target+$\alpha$1 (wherein the Target temperature is a temperature determined in view of the instant set of engine operating conditions and a1 is equal to 2° C. - note that the nature and method of deriving the target temperature will be discussed in some detail in connection with the flow chart shown in FIG. 13 hereinlater) then the program goes to step 1006 wherein an order to close valve II is issued. On the other hand, if the instant coolant temperature is found to be above target+$\alpha$1 then valve II is closed in step 1007 so as to hermetically seal the system into a closed state and thus prevent the situation wherein coolant and or coolant vapor can be undesirably forced out of the system by superatmospheric pressures. Following this, the output of level sensor 256 is sampled and in the event that the coolant in the lower tank is not above level H2 then the program flows to step 1009 wherein commands to stop the operation of the coolant return pump 218 and to condition valve I to produce flow path B are issued. Following this an abnormally high temperature control routine is run in step 1010. However, if the enquiry carried out in step 1008 reveals that the coolant level in lower tank 214 is in fact below level H2 then at step 1011 the coolant jacket level control program is run again. Following this, at step 1012 commands are issued to establish flow path A and to energize pump 218 in the first flow direction (viz., condition the system to pump coolant from the lower tank 214 to the reservoir 224.)

At step 1013 the temperature of the coolant is determined by sampling the output of temperature sensor 222 and ranged in a manner wherein if the temperature is above target+$\alpha$1 then the program recycles to step 1008 while if less than said value, at step 1014 the operation of pump 218 is stopped and valve I condition to produce flow path B. At step 1015 a command to stop the operation of fan 248 is issued and the program recycles to step 1003.

As will be appreciated while the temperature of the coolant is low (viz., below 80° C.) the system is held in an open state. However, upon the temperature of the coolant entering an acceptable range the program will recycle between steps 1004 and 1003 until such time as the goes above an upper limit which varies with operational conditions of the engine. Thus, in cold climates wherein the heat exchange efficiency the radiator need not be particlularly high by way of example), as soon as the temperture of the coolant enters the above mentioned acceptable range the system will be placed in a closed state even if the radiator is still partially filled with liquid coolant. This state will be maintained until such time as the inclusion of atmsopheric air or the like induces the situation wherein the temperature exceeds the optimal temperature by 2° C. Under such conditions the level of coolant in the lower tank 214 is determined. If excess coolant is found to be still contained in the radiator 210 steps are implemented to firstly maintain the coolant jacket level at H1 then pump an amount of coolant out to the reservoir 224. However, if the coolant level in the radiator 210 has been lowered to the minimum level (viz., H2) then it is deemed that air rather than excess coolant is the cause of the elevated temperautres and accordingly a suitable control routine is entered. Until such time as the temperature of the coolant drops sufficiently the program recycles from step 1013 to 1008 so as to repeat either the coolant displacement procedure or the 'hot purge' venting of non-condensible matter which characterizes the routine of step 1009.

COOLANT JACKET LEVEL CONTROL ROUTINE

Figure 10:
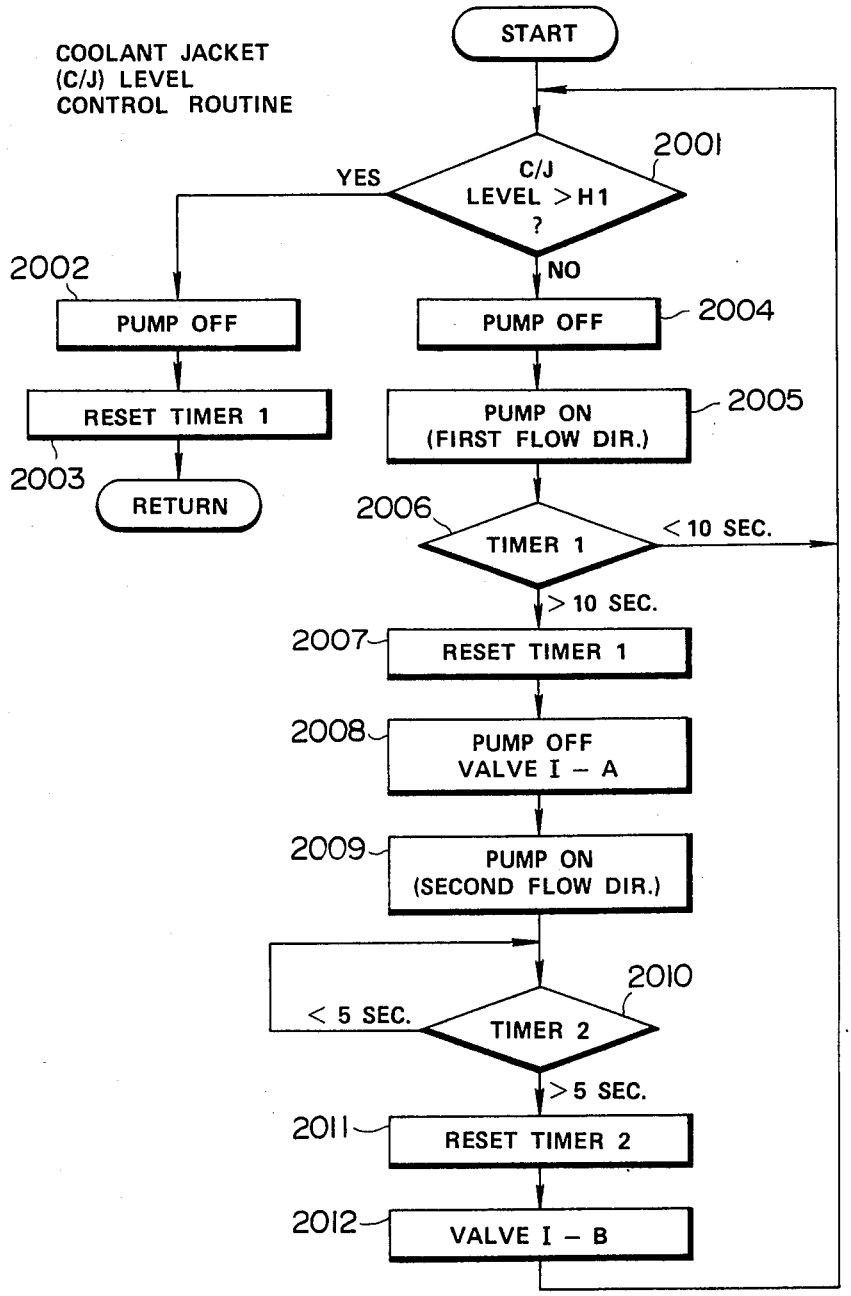

FIG. 10 shows in flow chart form the steps which characterize the coolant jacket level conrol routine.

As shown, the first step of this routine is such as to sample the output of level sensor 220 and determine if the level of coolant is below H1 or not. In the event that the level of coolant is above level H1 then at steps 2002 and 2003 a commmand to stop the operation of pump 218 is issued and a soft clock or 'time 1' is cleared and the program returns. On the other hand if the level of coolant in the coolant jacket is found to be insufficient (viz., below level H1) then the program goes to step 2004 wherein a command to stop the operation of the pump is issued. This step clears the pump control and ensures that the pump will not be energized in the wrong direction at step 2005. At step 2006 the soft clock or 'timer 1' is set counting for a period of ten seconds. In the event that the level of coolant in the coolant jacket comes up to H1 within this period then the program is switched at step 2001 and the program returns via steps 2002 and 2003. However, if the pump should be maintained on for the full count (10 seconds) then at step 2007 timer 1 is reset and at step 2008 a commands to stop the operation of pump 218 and condition valve 232 to establish flow path A are issued. Subsequently, at step 2009 pump 218 is energized to pump in the second flow direction and thus pump coolant from the reservoir 224 to the lower tank. This condition is maintained for a period of 5 seconds (see steps 2010 and 2011). Following this valve 232 is induced to switch back to flow path B and the program recycles. As will be appreciated steps 2008 to 2012 are such as to pump a little additional coolant into the system and thus slightly increase the total amount of coolant therein. This in combination with the control induced at steps 1012 and 1013 tends to hunt the amount of coolant toward exactly the desired level.

ABNORMALLY HIGH TEMPERATURE CONTROL ROUTINE

Figure 11:
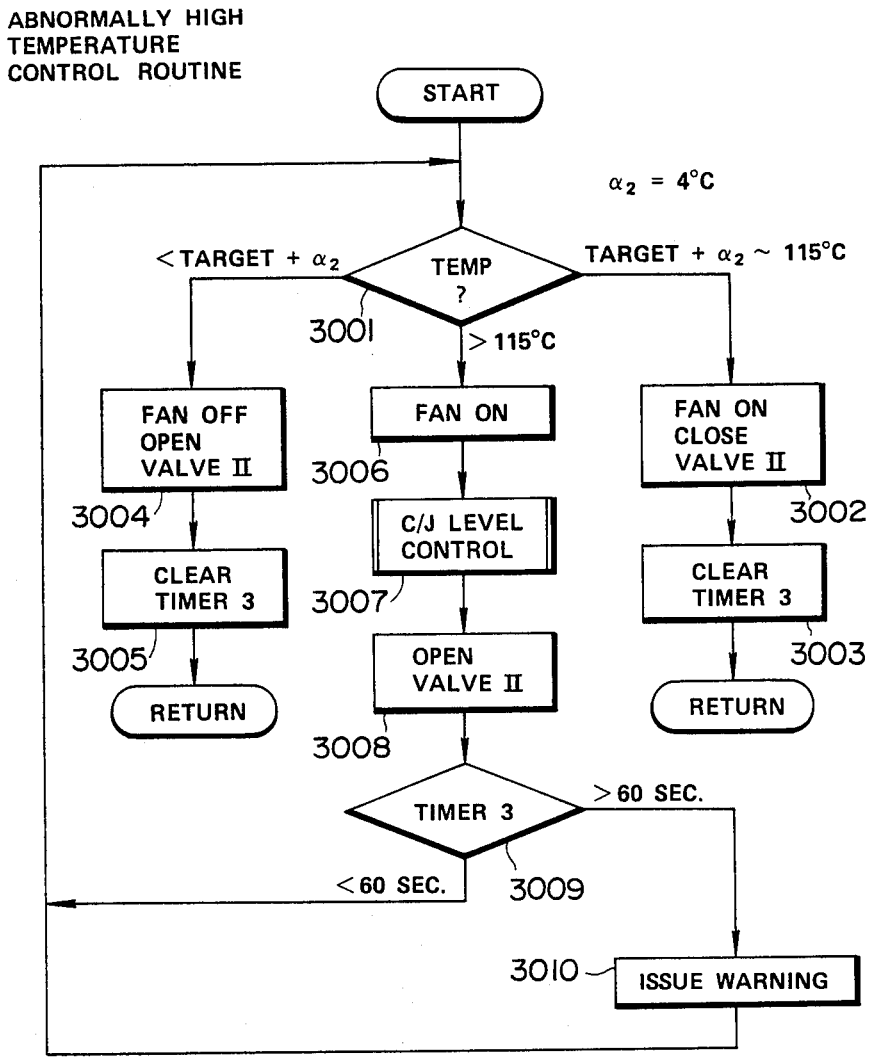
Figure 13:
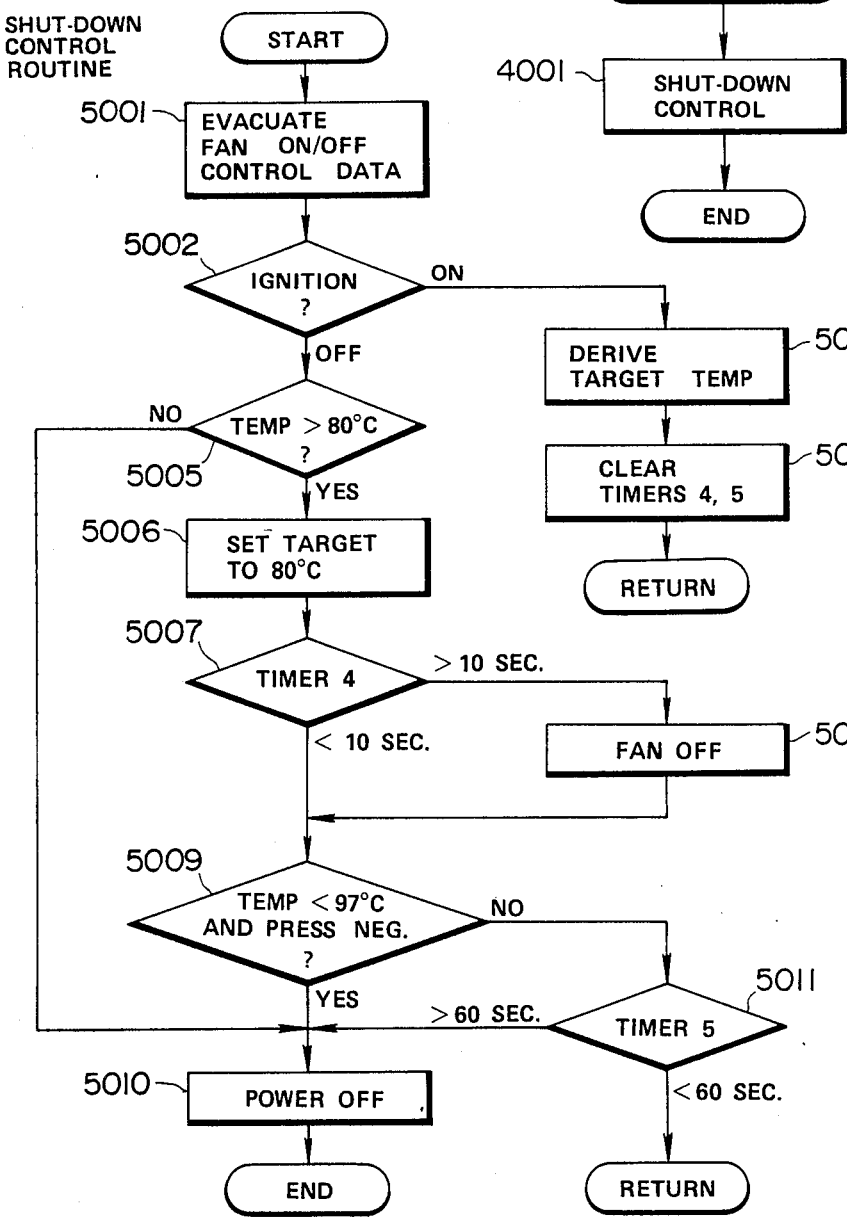

FIG. 11 shows the steps which characterize the abnormally high temperature control routine. As shown, at step 3001 the temperature of the coolant is determined and if within a rage of target+$\alpha$2 to 115° C. then at step commands to energize fan 248 and close valve II are issued. Following this at step 3003 a soft clock 'timer 3' is cleared in readiness for hot purge control. However, if the temperature determined in step 3001 is found to be lower than target+$\alpha$2 then at steps 3004 and 3005 commands to stop the operation of fan 248 and open valve II are issued and timer 3 cleared. On the other hand, if the temperature is determined to be above a maximum permissible limit (in this case 115° C.) then at step 3006 fan 248 is energized, at step 3007 the coolant jacket level control routine is run and at step 3008 valve II is conditioned to assume and open condition and thus permit coolant vapor to vent out of the radiator 210 via conduit 240 and thus perform what is is referred to in this specification as a 'hot purge'. As will be appreciated. As conduit 240 communicates with lower tank 224 at essentially the same level as sensor 256, this venting will tend to discharge little or no liquid coolant as the coolant level under such high temperature conditions will invariably be at H2. Further, the sudden momentary switch to open circuit status allows the pressurized coolant vapor to flow rapidly down through the radiator 210 carrying any traces of air (or the like) along therewith. Several runs of this program is usually sufficient to rid the system of any non-condensible matter and bring the temperature rapidly back into a desirable range.

Following step 3008 timer 3 is set counting (step 3009). In this embodiment counter 3 is arranged to count over a period of 60 seconds. In the event that the overheat condition is not controlled within this period then at step 3010 a warning is issued indicating that normal control measures have not proven effective and a prolonged overheat condition has been detected whereby the engine should be stopped and the cooling system inspected for apparatus malfuction.

INTERRUPT ROUTINE

Figure 12:
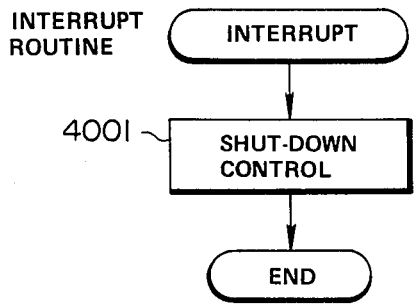

FIG. 12 shows an interrupt routine which is run at frequent intervals to determine the status of the engine and if it is necessary to implement a shutdown control routine which controls the cooling of the engine after the engine is stopped in a manner which obivates the loss of coolant and/or the induction of large amount of atmospheric air.

SHUT-DOWN CONTROL ROUTINE

The first step (5001) of this routine is such as to evacuate the current fan ON/OFF control data from the CPU and thus clear the way for a new set of control conditions. At step 5002 the status of the ignition switch is determined so as ascertain if the engine has been stopped by the driver or is still running. In the event that the engine is still in use (viz., the ignition key is still ON) then the program goes to steps 5003 and 5004 wherein the value of the target temperature is determined and timers 4 and 5 are cleared. However, if the igntion key is OFF, then at step 5005 the instant coolant temperature is sampled. In the event that the temperature is below 80° C. then the program flows directly to step 5010 wherein the power to the entire system is cut-off. However, if the coolant temperature is still above the minimum permissible level then at step the target value is set to 80° C. and a timer 4 set counting in a manner which prevents the operation of the fan 248 from being stopped for a period of 10 seconds. At step 5009 an enquiry is performed to determine if the instant coolant temperature is below 97° C. and the pressure prevailing within the cooling circuit is sub-atmospheric. The latter mentioned parameter is determined by sampling the output of the pressure differential switch arrangement 246.

If both of the conditions are simultaneously met then the program flows to step 5010 wherein the power supply is terminated otherwise at step 5011 timer 5 is set and while the count of this timer remains within 60 seconds and the both of the requirements of step 5009 are not met then the program is forced to return. As the coolant is above the newly set target temperature (80° C.) the operation of the cooling fan 248 will be induced as at step 3002 of the high temperature control routine.

What is claimed is:

1. In an internal combustion engine having a structure subject to high heat flux, a cooling system comprising:

(a) a cooling circuit for removing heat from said structure, said cooling circuit comprising:

a coolant jacket disposed about said structure and into which coolant is introduced in liquid form and permitted to boil;

a radiator in which coolant vapor is condensed to its liquid form;

a vapor transfer conduit leading from a vapor collection space defined in said coolant jacket to said radiator;

means for returning liquid coolant from said radiator to said coolant jacket in a manner which maintains said structure immersed in a predetermined depth of liquid coolant, said liquid coolant returning means including:

a coolant return conduit leading from the bottom of said radiator to said coolant jacket, and a pump disposed in said coolant return conduit, said pump being selectively energizable to return coolant from said radiator to said coolant jacket through said coolant return conduit;

(b) a reservoir in which liquid coolant is stored; and (c) valve and conduit means for selectively providing fluid communication between said reservoir and said cooling circuit, said valve and conduit means consisting of:

a first valve disposed in said coolant return conduit at a location between said pump and said coolant jacket, said first valve having a first position wherein communication between said pump and said coolant jacket is established and a second position wherein communication between said reservoir and said pump is established via a level control conduit which leads from said reservoir to said first valve, said pump being reversible so as to enable coolant to be pumped into or out of said coolant circuit when said first valve is in said second position;

a fill/discharge conduit which leads from said reservoir to the bottom of said radiator; and a second valve disposed in said fill/discharge conduit; said second valve having a first position wherein communication between said reservoir and said radiator is cut-off and a second position wherein communication is permitted.

2. A cooling system as claimed in claim 1, further comprising a temperature sensor for sensing the temperature of the coolant in said coolant jacket.

3. A cooling system as claimed in claim 1, wherein said liquid coolant returning means includes a first level sensor disposed in said coolant jacket at a predetermined height above said structure, the output of said first sensor being used to control said pump.

4. A cooling system as claimed in claim 3, further comprising an engine load sensor and a second level sensor disposed at the bottom of said radiator for sensing the level of coolant in the raditor being at a predetermined low level.

5. A cooling system as claimed in claim 4, further comprising means for controlling said device, said pump and said first and second valves in response to the data supplied from said temperature sensor, said engine load sensor, and the first and second level sensors.

6. A cooling system as claimed in claim 1, further comprising a device disposed with said radiator for increasing the rate of heat exchange between the radiator and a cooling medium which surrounds said radiator.

7. In an internal combustion engine having a structure subject to high heat flux, a method of cooling said engine comprising the steps of:

introducing liquid coolant into a coolant jacket disposed about said structure;

permitting said coolant to boil and produce coolant vapor;

condensing the coolant vapor produced in said coolant jacket to its liquid form in a radiator;

using a pump to return the liquid coolant from said radiator to said coolant jacket in a manner which maintains said structure immersed in a predetermined depth of coolant;

storing liquid coolant in a reservoir;

controlling the communication between said reservoir and a cooling circuit including said coolant jacket and said radiator using:

a first conduit which leads from said reservoir to said cooling circuit at a location between said pump and said coolant jacket;

a first valve which selectively provides communication between said pump and said reservoir via said first conduit and communication between said pump and said coolant jacket;

a second conduit which leads from the bottom of said radiator to said reservoir; and a second valve which selectively provides and cuts-off fluid commuication between said radiator and said reservoir via said second conduit;

permitting coolant from said reservoir to be inducted into said coolant jacket and radiator when the engine is stopped and below a predetermined temperature;

displacing coolant from said coolant jacket and radiator to said reservoir via said second conduit when the engine is started and warming up; and controlling the temperature and pressure in said coolant jacket and radiator by:

(i) increasing the exchange of heat between said radiator and a cooling medium surrounding same, (ii) pumping coolant into and out of said radiator and coolant jacket using said pump; and (iii) venting coolant vapor from said radiator via said second conduit when the temperature of the coolant in said coolant jacket rises above a maximum permissible level.

* * * * *